US006553198B1

(12) United States Patent
Slattery et al.

(10) Patent No.: US 6,553,198 B1
(45) Date of Patent: Apr. 22, 2003

(54) SINGLE PIECE CONTROL GRID ELECTRODE FOR A CORONA CHARGER

(75) Inventors: Scott Thomas Slattery, Brockport, NY (US); Thomas C. Bidwell, Rochester, NY (US); Michael Donovan Dunn, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/108,173

(22) Filed: Mar. 27, 2002

(51) Int. Cl.[7] ..... G03G 15/02

(52) U.S. Cl. ..... 399/171; 399/173; 250/324; 361/229

(58) Field of Search ..... 399/171, 173; 361/229, 230; 250/324, 325, 326

(56) References Cited

U.S. PATENT DOCUMENTS 3,959,690 A * 5/1976 Leibrecht ..... 313/351 X
5,206,784 A * 4/1993 Kimiwada et al. ..... 361/229
5,324,942 A * 6/1994 Mishra et al. ..... 250/324
5,666,604 A * 9/1997 Nakagami et al. ..... 250/324

FOREIGN PATENT DOCUMENTS

JP 2000250288 A * 9/2000 ..... G03G/15/02

* cited by examiner

*Primary Examiner*—Joan Pendegrass
*Assistant Examiner*—Candice C. Campbell
(74) *Attorney, Agent, or Firm*—Garola F. Fritz

(57) ABSTRACT

A single piece control grid electrode for a corona charging device for charging a curvilinear shaped dielectric support member with improved charging uniformity and consistency and with lower assembly and service cost. The single piece control grid is formed by a plurality of integral planar segments angularly oriented with respect to each other so that each segment may be equally spaced from the curvilinear shaped dielectric support member.

5 Claims, 5 Drawing Sheets

SINGLE PIECE CONTROL GRID ELECTRODE FOR A CORONA CHARGER

FIELD OF THE INVENTION

This invention relates in general to corona charging devices for use in electrostatographic reproduction machines, and more particularly to a control grid electrode for connection to a corona charging device used in such machines.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

In such reproduction apparatus, the dielectric support member is typically initially charged by spraying its surface with ions produced by a corona charging device. The corona charging device has a plurality of fine wires positioned transversely to the direction of motion of the dielectric support member and energized by a high voltage power supply. Corona emission from the wires ionizes air molecules, which are drawn to the surface of the dielectric support member as the dielectric support member moves past the wires. The quality of the developed image, especially that of pictorial images, is very dependent on the uniformity and consistency of the initial charge on the surface of the dielectric support member.

To improve the uniformity and consistency of the initial dielectric support member surface charge, it is known to provide an electrically biased control grid between the corona wires and the dielectric support member. The control grid includes a series of parallel wires or narrow metal strips closely spaced to each other and positioned transverse to the direction of motion of the dielectric support member. The spacing of the control grid wires to each other and to the dielectric support member surface, and the electrical bias voltage applied to the control grid wires, are the parameters that control the amount and spatial uniformity of the ionic charge deposited onto the surface of the dielectric support member. The surface voltage potential created on the dielectric support member is directly related to the bias voltage applied to the control grid wires.

The surface voltage created on the dielectric support member also depends upon the velocity at which such member moves past the corona charging device. For slower reproduction apparatus in which the dielectric support member velocity might only be a few inches per second, a corona charger with only one corona wire may be adequate. However, for higher speed reproduction apparatus in which the dielectric support member velocity might be 15–20 inches per second or higher, a corona charger with a plurality of corona wires may be required to achieve the required surface charge amount and uniformity.

Optimum charging efficiency, as well as uniformity and consistency of the deposited charge, is achieved when the control grid is closely and uniformly spaced from the surface of the dielectric support member. If the dielectric support member is curvilinear shaped and a corona charger with a plurality of corona wires is required, this would require that the control grid be provided with a curvature that matched the curvature of the dielectric support member. It is however very difficult to give this curvature to the control grid and still maintain the uniform spacing of the control grid from the dielectric support member surface because the control grid is typically made up of a plurality of closely spaced, thin wires. Tensioning the wires of a curved control grid so as to keep them uniformly spaced to each other and to the surface of the dielectric support member is very difficult.

U.S. Pat. No. 5,206,784 (issued Apr. 27, 1993, in the name of Kimiwada, et al.) addresses uniformly spacing the control grid from a cylindrically shaped member by dividing the control grid into a plurality of separate and independent planar grids equally spaced from the cylindrical member. The use of separate and independent planar grid sections is an effective compromise to a single piece curved grid, but the charger is costly to manufacture and difficult to assemble and to service if the grid sections become contaminated and must be replaced. It is difficult and time consuming to precisely position and equally tension the separate sections relative to each other as is required to achieve optimum dielectric support member surface charge uniformity and consistency.

SUMMARY OF THE INVENTION

In view of the above, it is the object of the present invention to provide a control grid electrode for a corona charging device for charging a curvilinear shaped dielectric support member with improved charging uniformity and consistency and with lower assembly and service cost. The single piece control grid is formed into a plurality of planar segments angularly oriented with respect to each other so that each segment is substantially equally spaced from the curvilinear shaped dielectric support member. Attaching this single piece control grid to the corona charging device during initial assembly and service replacement is easier than with separate segments. Further, maintaining the required spatial relationship between each segment and between the segments and the surface of the curvilinear shaped dielectric support member is facilitated by this arrangement. Thus assembly, operation, and service cost are optimized.

The invention, and its objects and advantages, will become apparent in the detailed description of the preferred embodiment presented below.

BRIEF DESCRIPTION OF THE DRAWINGS

Embodiment examples of a device according to the invention, from which other characteristics of the invention can also be gathered, but to which the invention is not limited in its scope, are shown schematically in the following drawings.

DETAILED DESCRIPTION OF THE INVENTION

Electrostatographic reproduction apparatus and corona charging devices for such apparatus, generally are well known. Therefore the present description will be directed in particular to elements forming part of, or cooperating more directly with the present invention. While the invention will be described with reference to an electrographic apparatus, the invention can also be used in other electrostatographic systems known in the art.

Figure 1:
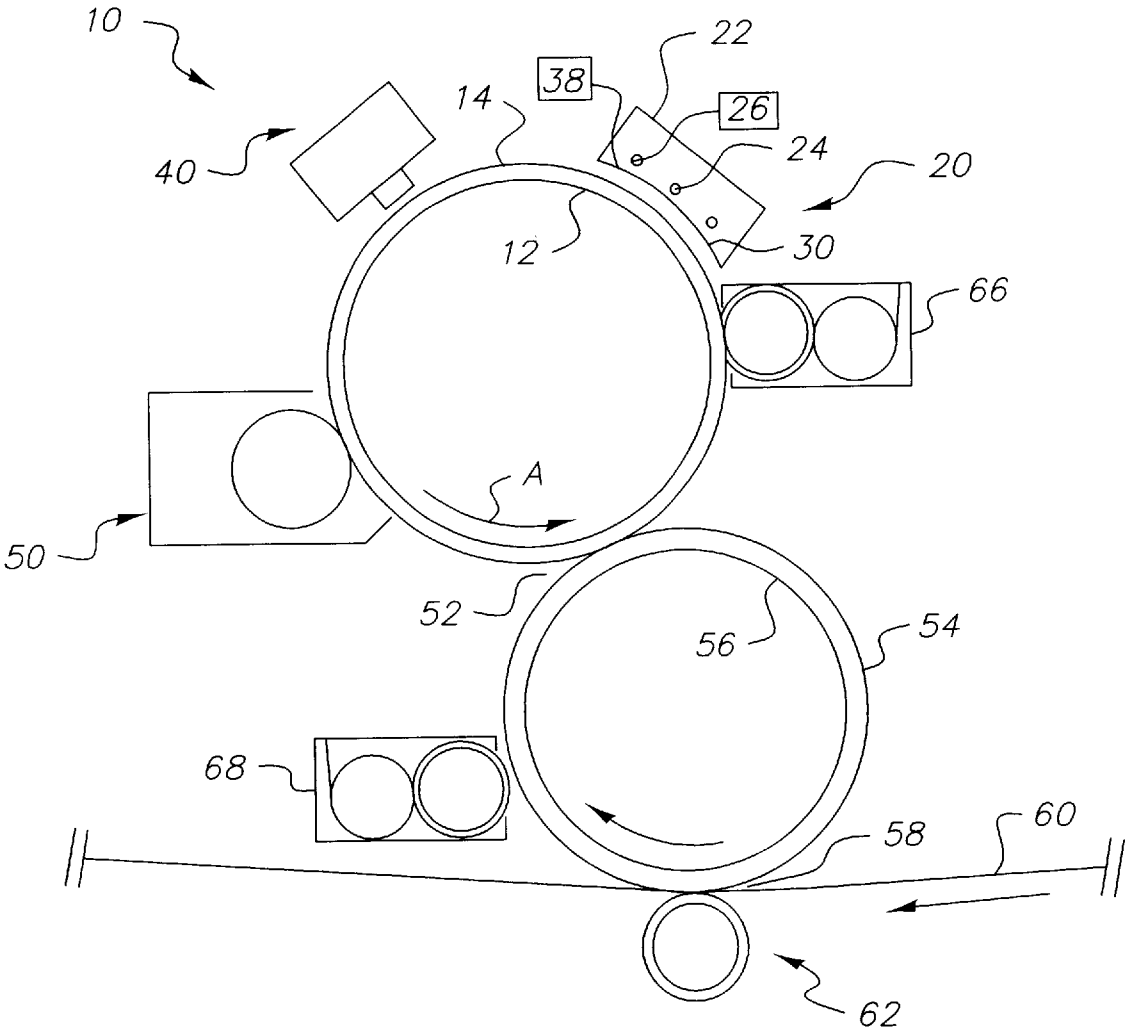
FIG. 1 is a schematic illustration showing a side elevation view of an electrographic reproduction apparatus, and showing a corona charging device having a control grid electrode in accordance with the present invention.
Figure 2:
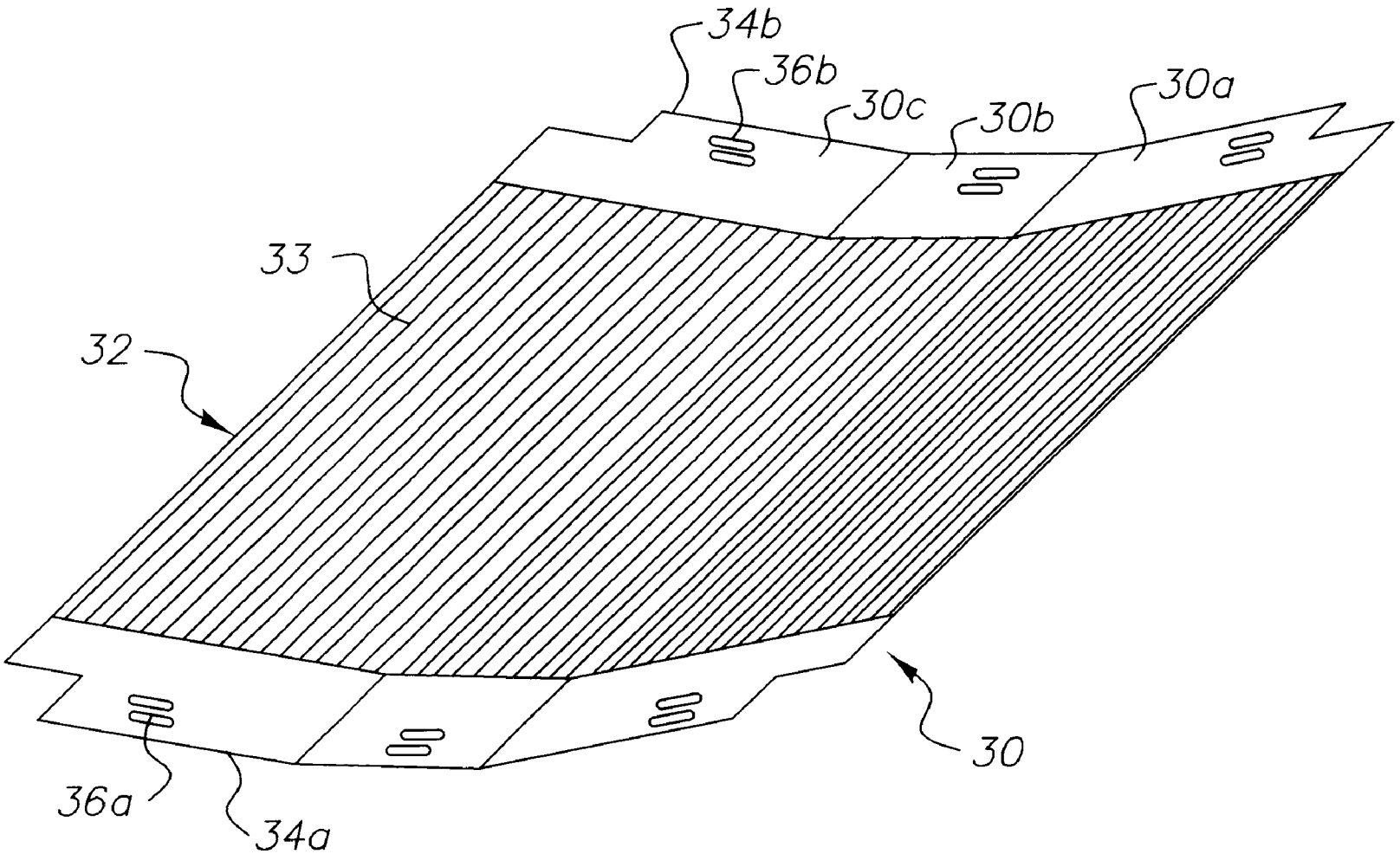
FIG. 2 is a view, in perspective, of the single piece formed control grid according to this invention.

With reference to the electrographic reproduction apparatus 10 as shown in FIG. 1, an imaging drum 12 is provided on which is coated a photoconductive dielectric support member 14. The imaging drum 12 is selectively rotated, by any well known drive mechanism (not shown), in the direction indicated by the arrow A, so as to advance the photoconductive dielectric support member 14 past a series of subsystems of the electrographic reproduction apparatus. A primary charging device 20 is provided for the purpose of depositing a uniform electrostatic charge onto the photoconductive dielectric support member 14. The primary charging device 20 includes a housing 22, corona wires 24 energized by a high voltage power supply 26, and a control grid 30, representative of the present invention, electrically biased by power supply 38. The amount of electrostatic charge deposited onto the photoconductive dielectric support member 14 by the primary charging device 20 is controlled by the bias voltage applied to the control grid 30 by the power supply 38.

The uniform charge on the photoconductive dielectric support member 14 is subsequently selectively dissipated by, for example, a digitally addressed exposure subsystem 40, such as a Light Emitting Diode (LED) array or a scanned laser, to form an electrostatic latent image of a document to be reproduced. The electrostatic latent image is then rendered visible by development subsystem 50, which deposits charged, pigmented marking particles onto the photoconductive dielectric support member 14 in accordance with the electrostatic charge pattern of the latent image. The developed marking particle image is then transported to nip 52 where it is transferred to a blanket 54, coated on an intermediate transfer drum 56. An electric potential difference applied between the intermediate transfer drum 56 and the imaging drum 12 creates an electric field that attracts the charged marking particles from the imaging drum 12 to the blanket 54 of the intermediate transfer drum 56. The image on the blanket 54 is then transported to nip 58 where it is transferred to a receiver sheet carried on transport belt 60. An electric potential difference applied between intermediate transfer drum 56 and backup roller 62 creates an electric field that attracts the charged marking particles from the intermediate transfer drum 56 to the receiver sheet. Cleaners 66 and 68 clean any marking particles that are not transferred from the photoconductive dielectric support member and blanket respectively. The receiver sheet bearing the marking particle image is then transported to a fusing subsystem to be fixed Alternatively, the receiver sheet bearing the marking particle image may be transported past subsequent electrographic reproduction apparatus identical to apparatus 10, to receive, for example, different color marking particle images in superimposed register.

The electrographic reproduction apparatus 10 described above is just one embodiment in which the present invention could be used. For example, the photoconductor dielectric support member could be coated on a flexible web entrained about a plurality of rollers or other supports and/or the developed marking particle image could be transferred directly to a receiver sheet rather than via an intermediate transfer drum.

With reference now to FIGS. 2–5, various views of the control grid 30 forming a preferred embodiment of the present invention are illustrated. A single piece formed control grid according to this invention is shown in perspective in FIG. 2 and, as noted above, designated generally by the numeral 30. In this embodiment of the present invention the single piece control grid 30 is shown formed into three angularly oriented segments 30*a*, 30*b*, 30*c*. It should, of course, be understood that the number of segments will depend upon the total width of the control grid which, in turn, will depend upon the number of corona wires in the corona charging device, the radius of the curvilinear shaped dielectric support member, and the desired predetermined spacing of the control grid from the peripheral surface of the curvilinear shaped dielectric support member.

Figure 3:
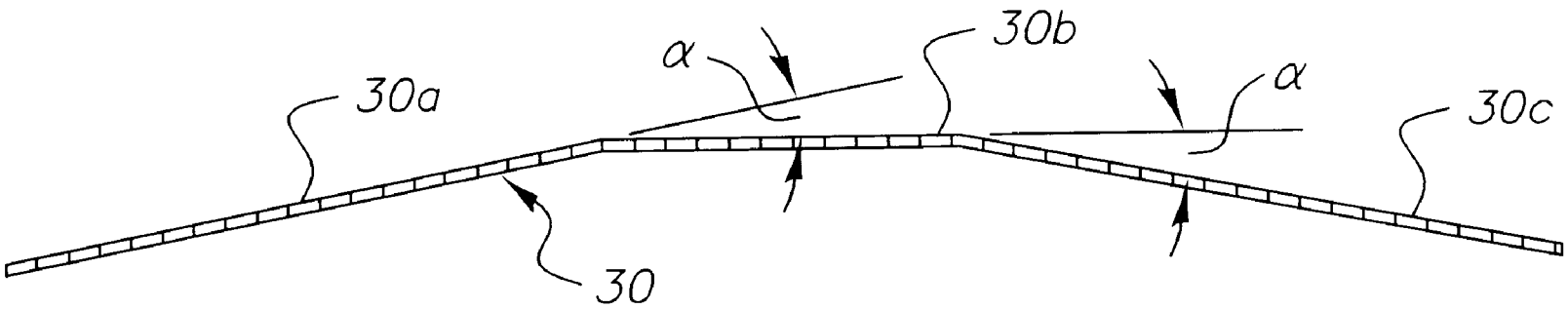
FIG. 3 is a view, in cross-section of the single piece formed control grid according to this invention.

Each segment 30*a*, 30*b*, 30*c* of the control grid 30 includes the center section 32, having a plurality of substantially parallel, electrically conducting wires or thin metal strips 33 terminating at each end into respective planar end sections 34*a* and 34*b*. As depicted in FIG. 3, the end sections of each segment are angularly oriented with respect to the end sections of adjacent segments by an angle $\alpha$. The angle $\alpha$ is determined by the width of each segment, the radius of the curvilinear portion of the dielectric support member 14 in juxtaposition with the corona charging device 20, and the desired predetermined spacing of the respective segments from the peripheral surface of the curvilinear shaped dielectric support member. In this preferred embodiment of the present invention the wires 33 and end sections 34*a*, 34*b* may be formed from the same planar metal sheet by selectively etching away material such as through any well known photoetching process, followed by die stamping the end sections into the desired predetermined angular relationship.

Figure 4:
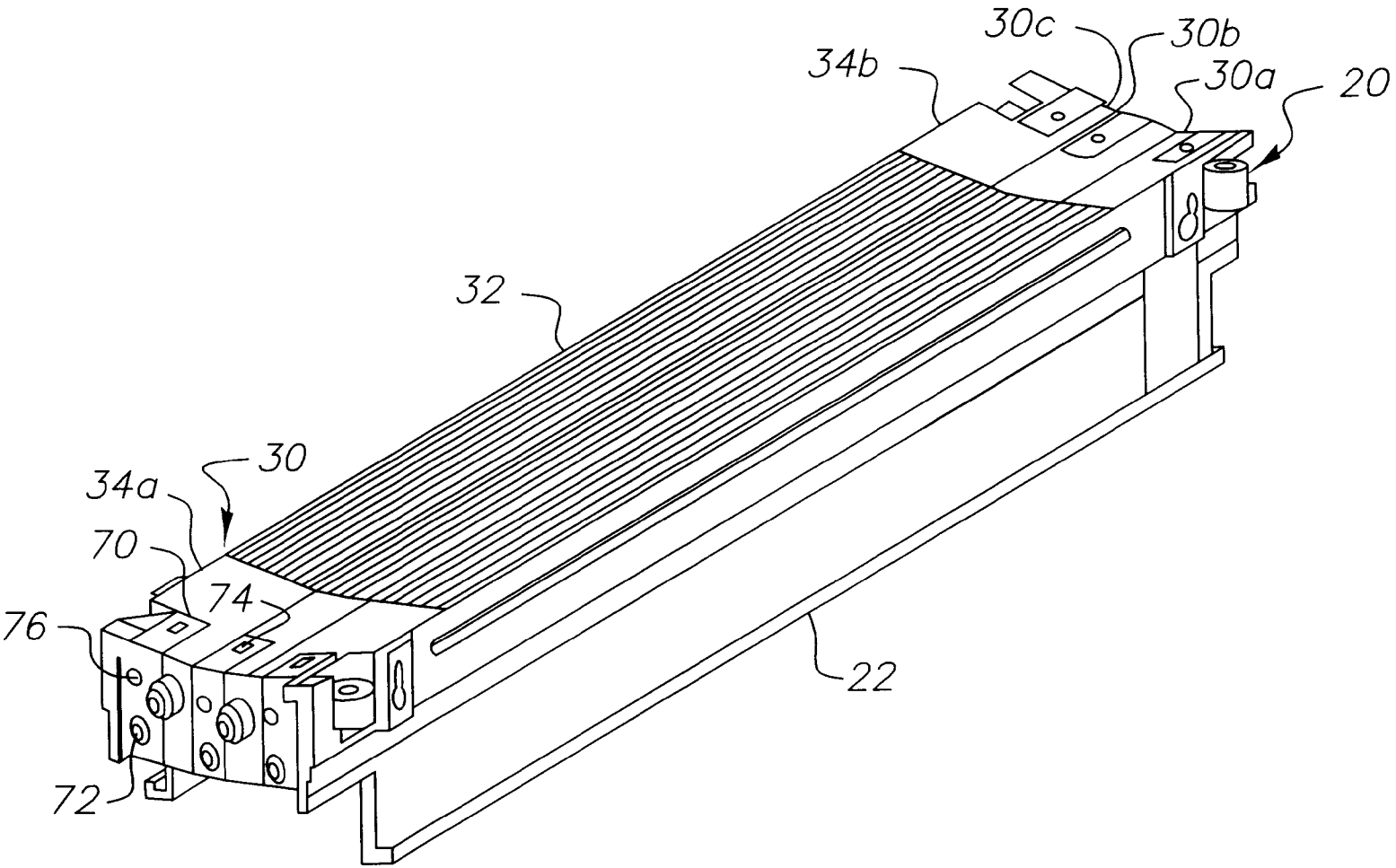
FIG. 4 is a view, in perspective, of the corona charging device with the single piece formed control grid of this invention attached thereto.
Figure 5:
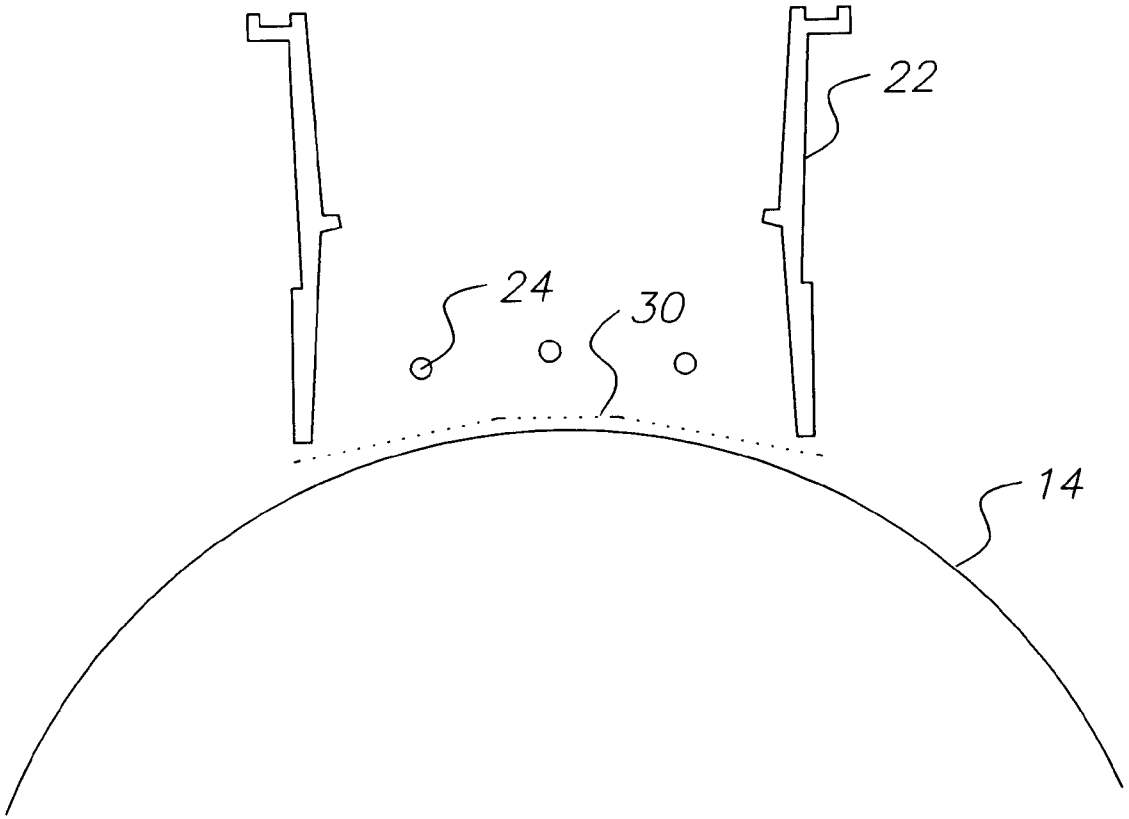
FIG. 5 is a view, in cross-section, showing the spatial relationship between the corona charging device corona wires, single piece formed control grid of this invention, and the cylindrical dielectric support medium surface.

FIG. 4 is a perspective view of the single piece control grid 30 attached to the housing 22 of the corona charging device 20. In this embodiment the control grid 30 is mounted on the corona charging device housing 22 by L-shaped sheet metal tabs 70 that are attached to the ends of the housing 22 with threaded fasteners 72. Lugs 74 on the sheet metal tabs 70 extend through apertures 36*a*, 36*b* formed in the respective end sections 34*a*, 34*b* of the control grid 30. Tension is selectively applied to the control grid 30 by screws 76, which are threaded through holes in the sheet metal tabs 70 and press against the end of the housing 22. Advancing the screws 76 through the threaded holes in the sheet metal tabs 70 pulls the tabs away from the ends of the housing 22, thus increasing the tension in the control grid 30. It should be understood that the above described method of mounting and tensioning the control grid of the present invention represents only one of any number of well known variations found in prior art. With the corona charging device 20 assembled as described, FIG. 5 represents a cross-section view showing the general spatial relationship of the high voltage corona wires 24, the single piece control grid 30, and the peripheral surface of the curvilinear shaped dielectric support member 14. As is readily seen, according to this invention the sections 30*a*, 30*b*, 30*c* of the control grid 30 are respectively at desired predetermined substantially equal spacing from the dielectric support member 14. Additionally the corona wires 24 may also be arranged to be at desired predetermined substantially equal spacing from the dielectric support member 14.

The invention has been described in detail with particular reference to certain preferred embodiments thereof, but it will be understood that variations and modifications can be effected within the spirit and scope of the invention.

What is claimed is:

1. A control grid electrode for attachment to a corona charging device for charging a curvilinear shaped dielectric support member, said control grid electrode comprising:

a plurality of planar segments, attached to each other and oriented with respect to each other so that said planar segments may be substantially equally spaced, at a predetermined distance, from said curvilinear shaped dielectric support member, said segments each respectively including a pair of spaced end sections and a center section terminating at each end to said end sections.

2. The control grid electrode of claim 1, wherein said center section of each said planar segment comprises a plurality of substantially parallel, electrically conducting wires extending longitudinally and integrally terminating at each end into said end sections.

3. A corona charging device for charging a curvilinear shaped dielectric support member, said corona charging device comprising:

a housing including substantially parallel longitudinal side walls, and traverse end sections, said longitudinal side walls terminating at said transverse end sections;

a plurality of substantially parallel corona wires extending in a longitudinal direction from one said traverse end section to the other said traverse end section; and a control grid electrode mounted on said housing, parallel to and spaced from said corona wires, said control grid having a plurality of planar segments, attached to each other and oriented with respect to each other so that said planer segments may be substantially equally spaced, at a predetermined distance, from said curvilinear shaped dielectric support member, said planar segments each respectively including a pair of spaced end sections and a center section terminating at each end to said end sections.

4. The corona charging device of claim 3, wherein said center section of each said planar segment comprises a plurality of substantially parallel, electrically conducting wires, extending longitudinally and integrally terminating at each end into said end sections.

5. The corona charging device of claim 4, wherein said end sections are adjustably connected to said traverse end sections of said housing.

* * * * *